US009902549B2

(12) United States Patent
Ciavarella

(10) Patent No.: US 9,902,549 B2
(45) Date of Patent: Feb. 27, 2018

(54) ELASTIC BLADDER DISPENSER

(71) Applicant: GOJO Industries, Inc., Akron, OH (US)

(72) Inventor: Nick Ermanno Ciavarella, Seven Hills, OH (US)

(73) Assignee: GOJO INDUSTRIES, INC, Akron, OH (US)

( * ) Notice: Subject to any disclaimer, the term of this patent is extended or adjusted under 35 U.S.C. 154(b) by 57 days.

(21) Appl. No.: 14/962,412

(22) Filed: Dec. 8, 2015

(65) Prior Publication Data

US 2016/0185506 A1 Jun. 30, 2016

Related U.S. Application Data

(60) Provisional application No. 62/088,910, filed on Dec. 8, 2014.

(51) Int. Cl.

| | |
|---|---|
| ***B65D 83/00*** | (2006.01) |
| *B65D 23/00* | (2006.01) |
| *B65D 81/32* | (2006.01) |
| *A47K 5/12* | (2006.01) |
| *B67D 1/08* | (2006.01) |
| *B65D 88/62* | (2006.01) |

(Continued)

(52) U.S. Cl.

CPC ..... *B65D 83/0072* (2013.01); *A47K 5/1211* (2013.01); *A47K 5/12* (2013.01); *B05B 9/047* (2013.01); *B05B 11/0043* (2013.01); *B65D 23/003* (2013.01); *B65D 81/3233* (2013.01); *B65D 83/0055* (2013.01); *B65D 88/62* (2013.01); *B67D 2001/0827* (2013.01)

(58) Field of Classification Search

CPC ..... B65D 83/0072; B65D 83/0055; B65D 88/62; B65D 23/003; B65D 81/3233; A47K 5/1211; A47K 5/12; B05B 9/047; B05B 11/0043; B67D 2001/0827

See application file for complete search history.

(56) References Cited

U.S. PATENT DOCUMENTS 4,901,886 A * 2/1990 Kirschner ..... B67D 1/1234 222/1

4,921,135 A * 5/1990 Pleet ..... B67B 7/26 222/105

(Continued)

*Primary Examiner* — Frederick C Nicolas

(74) *Attorney, Agent, or Firm* — Cooper Legal Group, LLC

(57) ABSTRACT

A dispensing system for dispensing an associated substantially viscous product includes a dispensing system housing and a first container. The first container is disposed within the dispensing system housing and has an elastically deformable wall defining a changeable volume for containing the associated product. The elastically deformable wall is expandable between an unexpanded state and an expanded state. The first container includes an outlet through which the associated product is expelled. Potential energy stored in the deformable wall in the expanded state is operable to expel the associated product from the first container through the outlet. The dispensing system includes a selectively engage-able valve operatively fluidly connected to the outlet for controlling the expulsion of a predetermined amount of the associated product from the outlet. An actuator is operatively coupled to the valve to selectively engage the valve.

8 Claims, 8 Drawing Sheets

(51) Int. Cl.
*B05B 11/00* (2006.01)
*B05B 9/047* (2006.01)

(56) References Cited

U.S. PATENT DOCUMENTS 5,096,092 A * 3/1992 Devine ..... B67D 1/0462 222/105
5,251,787 A * 10/1993 Simson ..... B67D 1/0462 222/105
5,301,838 A * 4/1994 Schmidt ..... B67D 1/0462 222/105
5,305,921 A * 4/1994 Kock ..... B05B 11/0043 222/105
5,312,018 A * 5/1994 Evezich ..... B65D 83/0055 222/105
7,308,991 B2 * 12/2007 Alberg ..... B67D 7/0261 156/291
8,028,857 B2 * 10/2011 Rasmussen ..... B67D 1/0001 137/205.5
8,733,598 B2 * 5/2014 Nelson ..... B67D 7/025 222/1
9,242,845 B2 * 1/2016 Otto ..... B67D 3/00
2013/0299518 A1 * 11/2013 McNulty ..... A47K 5/14 222/190
2014/0097201 A1 * 4/2014 Otto ..... B67D 3/00 222/95

* cited by examiner

ELASTIC BLADDER DISPENSER

CROSS-REFERENCE TO RELATED APPLICATIONS

This application claims priority to U.S. Provisional Application No. 62/088,910, titled "ELASTIC BLADDER DISPENSER" and filed on Dec. 8, 2014, the entire disclosure of which is hereby incorporated by reference.

TECHNICAL FIELD

The instant application is directed towards a dispensing system. For example, the instant application is directed towards a bladder for a dispensing system.

BACKGROUND

Dispensing systems can dispense a sanitizing product to a user. Dispensing systems can be used, for example, in schools, hospitals, nursing homes, factories, restaurants, etc.

SUMMARY

This summary is provided to introduce a selection of concepts in a simplified form that are further described below in the detailed description. This summary is not intended to identify key factors or essential features of the claimed subject matter, nor is it intended to be used to limit the scope of the claimed subject matter.

In an example, a dispensing system comprises a dispensing system for dispensing an associated substantially viscous product. The dispensing system comprises a dispensing system housing and a first container. The first container is disposed within the dispensing system housing and has an elastically deformable wall defining a changeable volume for containing the associated product. The elastically deformable wall is expandable between an unexpanded state and an expanded state. The first container comprises an outlet through which the associated product is expelled from. Potential energy stored in the deformable wall in the expanded state is operable to expel the associated product from the first container through the outlet. The dispensing system comprises a selectively engage-able valve operatively fluidly connected to the outlet for controlling the expulsion of a predetermined amount of the associated product from the outlet. The dispensing system comprises an actuator operatively coupled to the valve to selectively engage the valve.

In another example, a dispensing system comprises a dispensing system for dispensing an associated substantially viscous product. The dispensing system comprises a dispensing system housing and a first container. The first container is supported by the dispensing system housing. The first container has a deformable body defining a changeable volume for containing the associated product. The first container comprises an outlet through which the associated product is expelled from. The deformable body is expandable between an unexpanded state and an expanded state. A second container is supported by the dispensing system housing. The second container is pressurize-able. The first container is disposed at least partially within the second container. A pump has a pump inlet and a pump outlet. The pump inlet is operatively connected to the outlet. The pump is configured to receive the associated product that is expelled from the outlet of the first container through the pump inlet. The associated product exits the pump through the pump outlet. The pump comprises a second pump outlet. The second pump outlet is operatively connected to the second container for use in pressurizing the second container when the pump is actuated.

The following description and annexed drawings set forth certain illustrative aspects and implementations. These are indicative of but a few of the various ways in which one or more aspects can be employed. Other aspects, advantages, and/or novel features of the disclosure will become apparent from the following detailed description when considered in conjunction with the annexed drawings.

DETAILED DESCRIPTION

Figure 1:
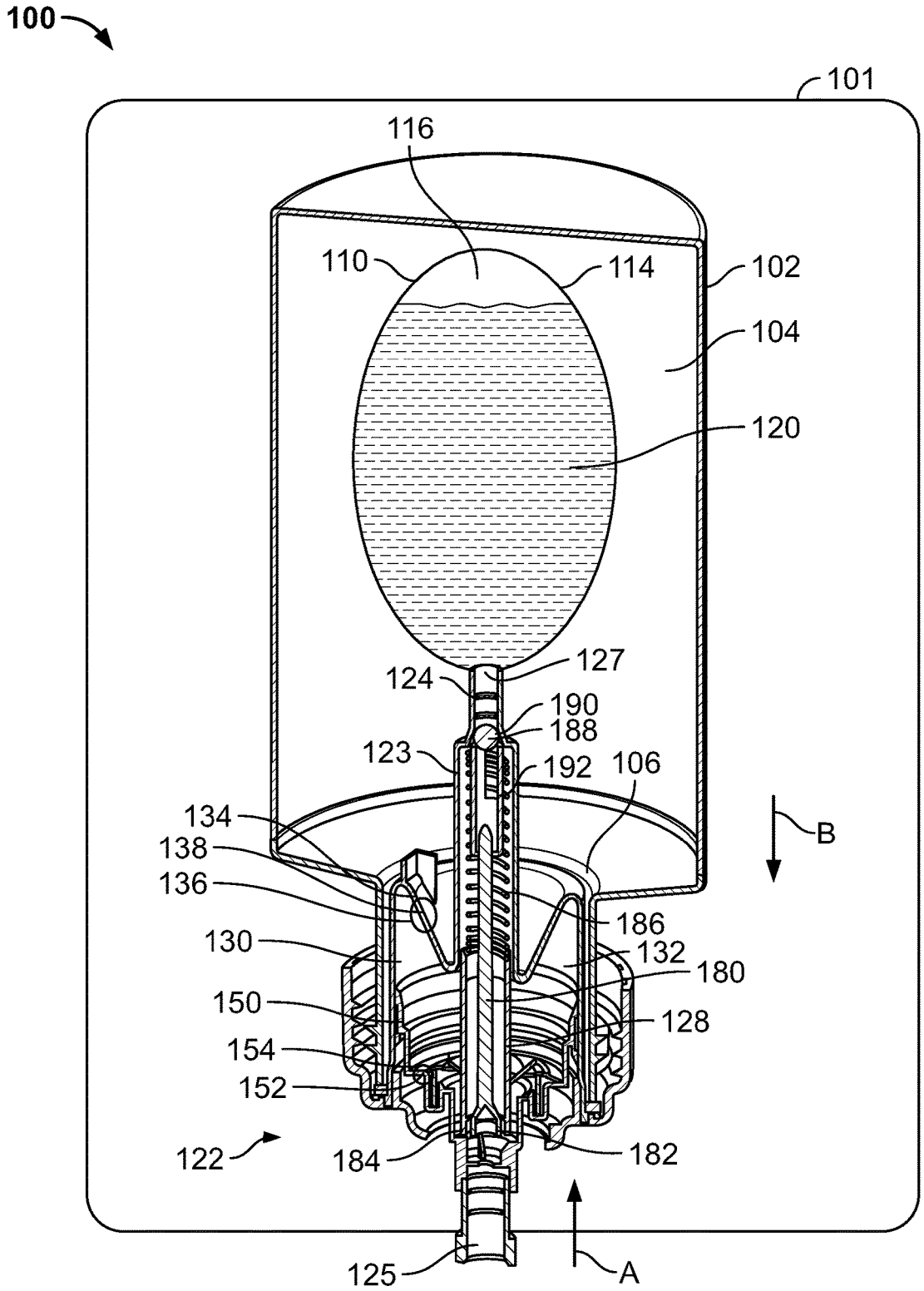
FIG. 1 is an illustration of an example dispensing system.

The claimed subject matter is now described with reference to the drawings, wherein like reference numerals are used to refer to like elements throughout. In the following description, for purposes of explanation, numerous specific details are set forth in order to provide an understanding of the claimed subject matter. It is evident, however, that the claimed subject matter can be practiced without these specific details. In other instances, structures and devices are illustrated in block diagram form in order to facilitate describing the claimed subject matter. Relative size, orientation, etc. of parts, components, etc. may differ from that which is illustrated while not falling outside of the scope of the claimed subject matter.

A dispensing system is provided for dispensing a substantially viscous product that tends to not self-settle by gravity. The product is stored within a first container. The product comprises, for example, soaps, cleaners, disinfectants, sanitizers, antiseptics, moisturizers, alcohol-infused liquids, or the like. Due to the product having a relatively high viscosity (e.g., between about 10,000 centipoise to about 50,000 centipoise), a pump may be provided to assist in expelling the product from the dispensing system. For example, the pump can pressurize a chamber around the first container, with this pressurization facilitating expulsion of the product from the container.

Turning to FIG. 1, an example dispensing system 100 is illustrated. The dispensing system 100 can be used for storing and/or dispensing an associated substantially viscous product. By being an associated substantially viscous product, the product may be stored partially and/or completely within the dispensing system 100. The dispensing system 100 can be attached, for example, to a surface, such as a surface of a wall, ceiling, door, object, support structure, etc. The dispensing system 100 can be used in a number of environments, including prisons, jails, detention centers, mental health facilities, hospitals, mental hospitals, rehabilitation facilities, nursing homes, restaurants, schools, factories, warehouses, etc.

The dispensing system 100 comprises a dispensing system housing 101. The dispensing system housing 101 comprises an enclosure, case, cover, or other similar structure for storing one or more structures therein. The dispensing system housing 101 may comprises a rigid and/or durable structure or material that is substantially resistant to tampering and/or inadvertent access. The dispensing system housing 101 can be attached to a surface, such as a surface of a wall, ceiling, door, object, support structure, etc.

The dispensing system 100 comprises a second container 102 that envelopes a first container 110 and is disposed within the dispensing system housing 101. The second container 102 comprises a container, enclosure, etc. within which portions of the dispensing system 100 may be housed. In some examples, the second container 102 is substantially hollow so as to receive structures therein. In the illustrated example, the second container 102 comprises a rigid and/or durable structure or material, such as a plastic material, a metal material, or the like.

The second container 102 defines a first chamber 104 that is at a first chamber pressure. In some examples, the first chamber 104 can be at a higher pressure than standard atmosphere, lower than standard atmosphere, or substantially equal to standard atmosphere. According to some examples, the second container 102 is sealed, such that inadvertent ingress or egress of air into and/or out of the first chamber 104 is limited. In an example, the second container 102 can define an opening 106 at which a pump 122 may be attached to the second container 102, such as by a gasket, O-ring, adhesive, or the like, to establish a substantially sealed or airtight relationship between the second container 102 and the pump 122. As will be appreciated (e.g., FIGS. 2 and 3), a pressurization material (e.g., air, gas, fluid, etc.) can flow into the first chamber 104 from a pressurization chamber 132 defined by the pump 122. In an example, the pressurization material flows into the first chamber 104 depending upon respective states (e.g., opened position, closed position, etc.) of one or more valves of the pump 122, where the respective states are, for example, a function of relative movement between a portion of the pump 122 and the second container 102 (e.g., a valve may open such that air may flow from the pressurization chamber 132 into the first chamber 104 when a user pushes up on a portion of the pump forcing the portion of the pump towards the second container thereby decreasing a volume of the pressurization chamber 132). The second container 102 is thus pressurizeable in some embodiments, where a pressure within the second container, when sufficient, facilitates an expulsion of associated product from the first container 110.

The dispensing system 100 comprises the first container 110 disposed within the dispensing system housing 101 and within the second container 102. The first container 110 comprises an inner container, enclosure, etc. within the second container 102. For example, the first container 110 can be deformable and positioned within the first chamber 104. By being deformable, it is understood that the first container 110 may comprise an elastomeric material, similar to a balloon or the like. In other examples, the first container 110 comprises a flexible bag or the like. The first container 110 comprises rubber, latex, polychloroprene, nylon fabrics, or other similar materials that have at least some degree of flexibility, expandable, compressible, elasticity, etc.

In an example, at least some of the first container 110 does not comprise the elastomeric material but is instead rigid or substantially rigid. For example, the first container 110 may comprise a rigid or substantially rigid first portion (e.g., piston head) nested into a rigid or substantially rigid second portion (e.g., piston bore), with the first portion and the second portion movable relative to one other (e.g., the piston head may move up and down, side to side, etc. within the piston bore). In such an example, even though the first portion and the second portion may be rigid or substantially rigid, the first container 110 may nevertheless be regarded as being deformable (e.g., because of the relative movement between the first portion and the second portion). In an example, the first container 110 may comprise both the elastomeric material and a rigid or stiff material. For example, the elastomeric material may bias a portion of the first container 110 to a particular state (e.g., the elastomeric material may pull a piston head back up after the piston head has been depressed into a piston bore (e.g., to dispense product)).

The first container 110 has an elastically deformable wall 114 that defines a changeable volume 116 for containing an associated substantially viscous product 120 (hereinafter "product"). As will be described, the elastically deformable wall 114 is expandable between an unexpanded state and an expanded state. As the elastically deformable wall 114 moves from the expanded state to the unexpanded state, the changeable volume 116 decreases, such that the product 120 can be dispensed.

The first container 110 can contain and dispense the product 120. In an example, the product 120 comprises a relatively high viscous product that tends to not self-settle by gravity. The product 120 comprises, for example, soaps, cleaners, disinfectants, sanitizers, antiseptics, moisturizers, alcohol-infused liquids, or the like. In other examples, the product 120 comprises non-cleaning liquid or semi-liquid products. In an example, the product 120 may have a viscosity of between about 10,000 centipoise to about 50,000 centipoise.

The dispensing system 100 comprises a pump 122. The pump 122 is in fluid communication with the first chamber 104. In some examples, the pump 122 can be attached to the second container 102, such as by being positioned adjacent or within the opening 106. In other examples, the pump 122 could be spaced away from the second container 102, and may be in fluid communication with the opening 106 through a tube, conduit, or the like.

The pump 122 has a dispensing structure 123 that defines a first pump inlet 124 and a first pump outlet 125. The first pump inlet 124 is operatively connected to an outlet 127 of the first container 110. The pump 122 is configured to receive the product 120 that is expelled from the outlet 127 of the first container 110 through the first pump inlet 124. The product 120 can exit the pump 122 through the first pump outlet 125.

In an example, the first pump inlet 124 of the pump 122 can be in fluid communication with the first container 110 such that the pump 122 is in fluid communication with the product 120 within the first container 110. For example, the dispensing structure 123 of the pump 122 can be attached at an end (e.g., at an upper end of the dispensing structure 123) to the first container 110 (e.g., at a lower end of the first container 110). The dispensing structure 123 can extend outwardly from the first container 110 towards an opposing end (e.g., lower end of the dispensing structure 123), such that the product 120 can be dispensed through the dispensing structure 123.

The dispensing structure comprises a movable shaft 128. The movable shaft 128 can extend between the first pump inlet 124 and the first pump outlet 125. In an example, the movable shaft 128 is capable of movement, such as in response to an upwards force (e.g., as indicated by arrow A). The movable shaft 128 is substantially hollow, such that the product 120 can flow through the movable shaft 128 when the product 120 flows from the first pump inlet 124 to the first pump outlet 125.

In an example, the movable shaft 128 can receive an inner shaft 180. For example, the movable shaft 128 may be substantially hollow such that the inner shaft 180 can extend through a center of the movable shaft 128. In an example, the inner shaft 180 has a length that is larger than a length of the movable shaft 128. The inner shaft 180 comprises an engagement portion 182 located at an end (e.g., at a lower end) of the inner shaft 180. In this example, the engagement portion 182 has a varying cross-sectional size that increases in a direction away from the first container 110 towards the lower end of the inner shaft 180. In the illustrated example, the engagement portion 182 has an inverted Y-shape, an inverted U-shape, or the like.

The movable shaft 128 comprises a sealing portion 184 located at an end (e.g., at a lower end) of the movable shaft 128. In this example, the sealing portion 184 has a cross-sectional size that is similar to a cross-sectional size of the engagement portion 182, such that the sealing portion 184 can contact and/or engage the engagement portion 182. For example, the sealing portion 184 of the movable shaft 128 can circumferentially surround the engagement portion 182 of the inner shaft 180, with the engagement portion 182 contacting the sealing portion 184. When the engagement portion 182 and the sealing portion 184 are in contact, a seal may be formed between the engagement portion 182 and the sealing portion 184, such that the product 120 is substantially limited from bypassing between the engagement portion 182 and the sealing portion 184.

A biasing device 186 (e.g., a spring) can be provided in contact with the movable shaft 128. In this example, the biasing device 186 is positioned adjacent to an end (e.g., at an upper end) of the movable shaft 128. In some examples, the biasing device comprises a spring. The biasing device 186 can bias the movable shaft 128 downwardly, such that the sealing portion 184 contacts the engagement portion 182 of the inner shaft 180. However, in response to upward force (e.g., as indicated by arrow A), the movable shaft 128 can be moved upwardly such that the sealing portion 184 does not contact the engagement portion 182.

A ball valve 188 can be positioned towards an upper end of the movable shaft 128. The ball valve 188 can be in contact with a valve seat 190 that is located within the dispensing structure 123. In an example, when the ball valve 188 is in contact with the valve seat 190, the ball valve 188 can selectively block, obstruct, etc. the first pump inlet 124 of the dispensing structure 123. As such, when the ball valve 188 is in contact with the valve seat 190, the product 120 is substantially limited from bypassing between the ball valve 188 and the valve seat 190. In this example, the ball valve 188 can rest upon a support device 192. The support device 192 can be biased, such as by the biasing device 186, to support the ball valve 188 in contact with the valve seat 190. As will be described further below, the biasing force of the biasing device 186 can be overcome, such as during a downward stroke or movement of the movable shaft 128, so that the support device 192 moves downward and the ball valve 188 is not in contact with the valve seat 190, thereby allowing the product 120 to pass between the ball valve 188 and the valve seat 190.

As will be described in more detail below, in an example, a portion of the pump 122 (e.g., second pressurization sidewall 150) may be movable relative to the second container 102. For example, the second pressurization sidewall 150 can be moved upwardly with respect to the second container 102 (e.g., as indicated by arrow A) and/or the second container 102 can be moved downwardly (e.g., as indicated by arrow B) relative to the second pressurization sidewall 150.

Movement (e.g., as indicated by arrows A and/or B) can pressurize the first chamber 104 to a second chamber pressure that is greater than the first chamber pressure. As will be described in more detail below, a position of the pump 122 relative to the second container 102 is movable between a first position (e.g., as illustrated in FIG. 1), in which the first chamber 104 is at the first chamber pressure, and a second position.

The pump 122 comprises one or more pressurization sidewalls 130, 150. In an example, the pump 122 comprises a first pressurization sidewall 130 and a second pressurization sidewall 150. The first pressurization sidewall 130 and the second pressurization sidewall 150 are movable with respect to each other. The pump 122 comprises a pressurization chamber 132 that is defined by the pressurization sidewalls 130, 150. The pressurization chamber 132 is a substantially hollow chamber that is maintained at a pressure. A pressurization material (e.g., air, gas, fluid, etc.) can flow into and out of the pressurization chamber 132.

The pressurization sidewalls 130 comprise a third pressurization sidewall 134 that defines a second pump outlet 136. In this example, the third pressurization sidewall 134 borders and/or is adjacent the first chamber 104 of the second container 102. As such, the first chamber 104 is located on one side (e.g., upper side) of the third pressurization sidewall 134 while the pressurization chamber 132 is located on an opposite side (e.g., lower side) of the third pressurization sidewall 134. In some examples, the first pressurization sidewall 130 and the third pressurization sidewall 134 are a one-piece structure (e.g., together comprising a single sidewall) while in other examples, the first pressurization sidewall 130 and the third pressurization sidewall 134 can be separately attached and sealed together.

The pump 122 comprises a first valve 138 (e.g., illustrated schematically as the first valve 138 comprises a number of different valve configurations) positioned within the second pump outlet 136. The first valve 138 comprises any number of valves, such as check valves, one way valves, or the like. In an example, the first valve 138 is movable between an opened position (e.g., illustrated in FIG. 2), in which the pressurization material flows from the pressurization chamber 132, through the second pump outlet 136, and into the first chamber 104, and a closed position (e.g., illustrated in FIG. 1), in which the pressurization material does not flow through the second pump outlet 136. In some examples, the first valve 138 can be biased towards the closed position, such that the pressurization material may not flow through the second pump outlet 136. However, in response to a pressure, such as an increased pressure within the pressurization chamber 132, the first valve 138 can move to the opened position, such that the pressurization material can flow therethrough.

The second pressurization sidewall 150 defines a second pump inlet 152. In this example, the second pressurization sidewall 150 and the third pressurization sidewall 134 are spaced apart, such that the third pressurization sidewall 134 and the second pressurization sidewall 150 can together, at least in part, define the pressurization chamber 132 between them. The second pressurization sidewall 150 is located adjacent the pressurization chamber 132 on one side (e.g., upper side) and adjacent an exterior environment on an opposite side (e.g., lower side).

The pump 122 comprises a second valve 154 positioned within the second pump inlet 152. The second valve 154 comprises any number of valves, such as check valves, one way valves, or the like. In an example, the second valve 154 is movable between an opened position (illustrated in FIG. 4*a*), in which the pressurization material flows from the exterior environment, through the second pump inlet 152, and into the pressurization chamber 132, and a closed position (illustrated in FIG. 1), in which the pressurization material does not flow through the second pump inlet 152. In some examples, the second valve 154 can be biased towards the closed position, such that the pressurization material may not flow through the second pump inlet 152. However, in response to a pressure, such as a decreased pressure within the pressurization chamber 132, the second valve 154 can move to the opened position, such that the pressurization material can flow therethrough and pressurize the pressurization chamber 132.

The second pressurization sidewall 150 can be sealed with respect to the first pressurization sidewall 130 so as to limit unintended ingress and egress of the pressurization material into and out of the pressurization chamber 132. In an example, an internal area defined by the second pressurization sidewall 150 has a smaller cross-sectional size (e.g., diameter) than a cross-sectional size of an internal area defined by the first pressurization sidewall 130. As such, the second pressurization sidewall 150 can be positioned radially adjacent an inner side of the first pressurization sidewall 130. In such an example, an outer radial side of the second pressurization sidewall 150 can be sealed with respect to an inner radial side of the first pressurization sidewall 130. Accordingly, due to this seal, movement of the second pressurization sidewall 150 with respect to the first pressurization sidewall 130 can limit the pressurization material from flowing between the first pressurization sidewall 130 and the second pressurization sidewall 150 either into or out of the pressurization chamber 132.

It will be appreciated that the pump 122 is illustrated schematically, as the pump 122 comprises any number of structures, configurations, sizes, shapes, methods of operation, etc. Indeed, FIG. 1 illustrates merely one example of the pump 122, as other types of pumps 122 are envisioned. The pump 122 can function to selectively pressurize the first chamber 104 of the second container 102. Accordingly, the pump 122 illustrated in FIG. 1 need not be construed as a limitation on the dispensing system 100.

In operation, a user can move a portion of the pump 122 (e.g., the second pressurization sidewall 150) with respect to the second container 102 (e.g., as indicated by arrow A) and/or the second container 102 with respect to the pump 122 (e.g., as indicated by arrow B).

Figure 2:
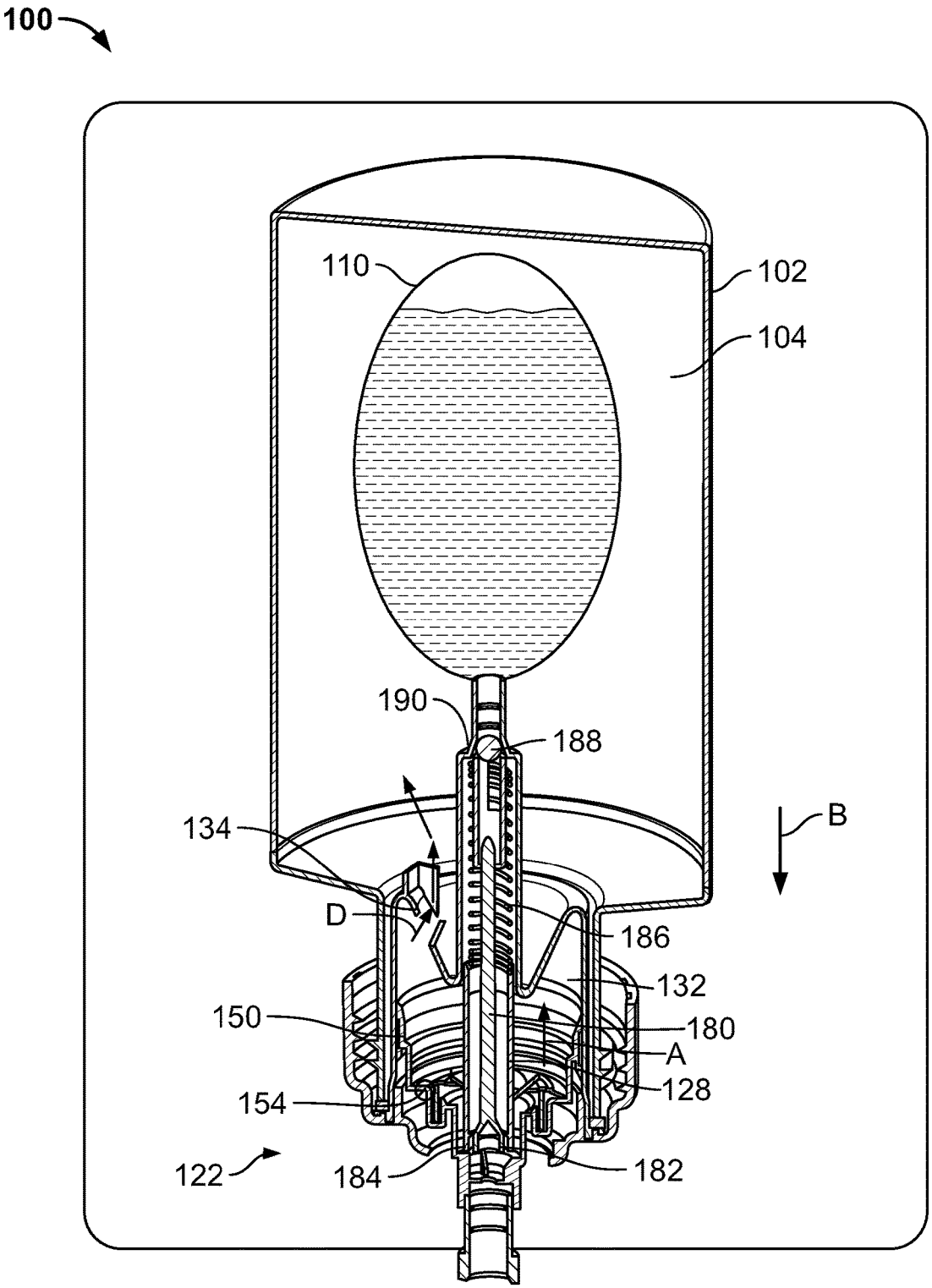
FIG. 2 is an illustration of an example dispensing system.

Turning now to FIG. 2, the dispensing system 100 is illustrated as the second pressurization sidewall 150 of the pump 122 is moved with respect to the first pressurization sidewall 130. In this example, the second pressurization sidewall 150 is movable (e.g., as indicated by arrow A) in an upward direction from the first position to a second position. In addition or in the alternative, the second container 102 may be movable (e.g., as indicated by arrow B) in a downward direction relative to the second pressurization sidewall 150. In the second position, the second pressurization sidewall 150 may be in closer proximity to the third pressurization sidewall 134 than in the first position. Additionally, as the second pressurization sidewall 150 is moved (e.g., as indicated by arrow A) and/or the second container 102 is moved (e.g., as indicated by arrow B), the movable shaft 128 can likewise be moved upwardly relative to the second pressurization sidewall 150 (e.g., as indicated by arrow A) against the biasing device 186 (e.g., compressing the spring) forcing the ball valve 188 into contact with the valve seat 190. As the movable shaft 128 is moved upwardly, the sealing portion 184 of the movable shaft 128 moves out of contact with the engagement portion 182 of the inner shaft 180 such that a gap, space, opening, channel, or the like is temporarily created between the engagement portion 182 of the inner shaft 180 and the sealing portion 184 of the movable shaft 128.

In this example, the second pressurization sidewall 150 of the pump 122 is moved with respect to the first pressurization sidewall 130 to a second position (e.g., by moving the second pressurization sidewall 150 upwardly as indicated by arrow A and/or by moving the second container 102 downwardly as indicated by arrow B). In the second position, the pump 122 pressurizes the first chamber 104 to a second chamber pressure that is greater than the first chamber pressure (e.g., pressurization material (e.g., air) flows from the pressurization chamber 132 to the first chamber 104 as indicated by arrow D). In this example, due to the second pressurization sidewall 150 moving upwardly towards the third pressurization sidewall 134, the volume of the pressurization chamber 132 is reduced. As such, the pressurization material within the pressurization chamber 132 can cause the first valve 138 to move from the closed position (illustrated in FIG. 1) to the opened position (illustrated in FIG. 2). In this example, the second valve 154 may remain in the closed position. Accordingly, this pressurization material flow (e.g., as indicated by arrow D) can pressurize the first chamber 104 to the second chamber pressure that is greater than the first chamber pressure.

Figure 3:
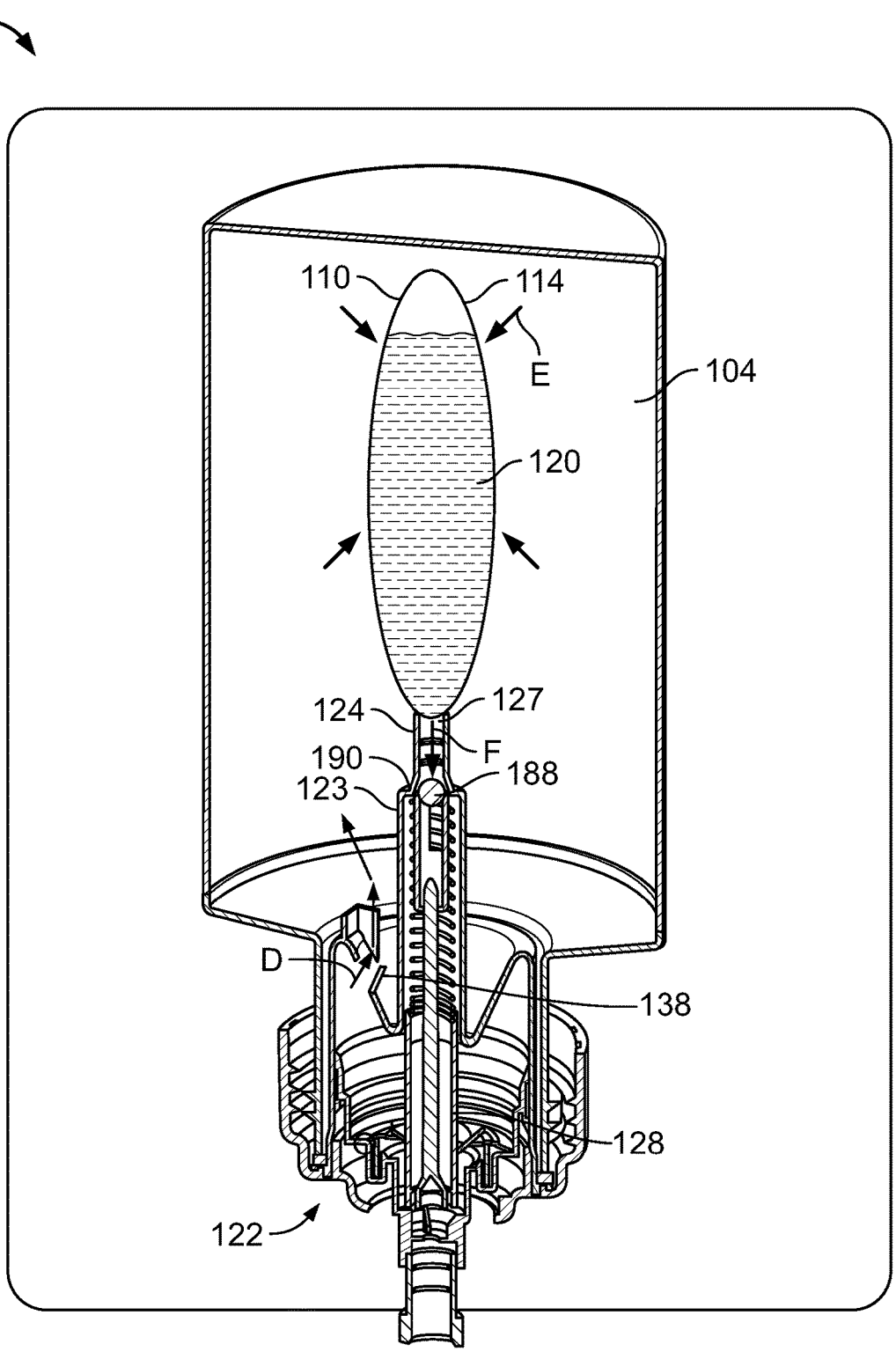
FIG. 3 is an illustration of an example dispensing system.

Turning now to FIG. 3, the pressurization of the first chamber 104 to the second chamber pressure can cause the first container 110 to deform, such that the product 120 is dispensed from the first container 110. For example, the elastically deformable wall 114 of the first container 110 is compressible from the expanded state (e.g., as illustrated in FIGS. 1 and 2) to the unexpanded state (e.g., as illustrated in FIG. 3). For example, due to the first container 110 being deformable (e.g., elastomeric material, nesting and/or movable portions of first container 110, etc.), a pressure (e.g., as indicated by arrow E) of the second chamber pressure can act on the first container 110 thus causing the first container 110 to deform. In this example, the first valve 138 can remain in the opened position as the pump 122 further moves from the first position to the second position.

It will be appreciated that the pressure (e.g., as indicated by arrow E) may be substantially uniform on the outer surface of the first container 110. Furthermore, the deformation of the first container 110 is likewise illustrated schematically, in that the first container 110 in FIG. 3 has a reduced volume as compared to the first container 110 illustrated in FIGS. 1 and 2. In operation, however, deformation of the first container 110 may or may not be uniform, such that certain portions of the first container 110 may deform to a greater or lesser degree than other portions of the first container 110. However, the deformation of the first container 110 can cause a reduction in volume within the first container 110 such that the product 120 may be dispensed from the first container 110 through the outlet 127.

Accordingly, in response to the deformation of the first container 110, the product 120 can be at least partially dispensed from the first container 110. In such an example, the product 120 can exit the first container 110 (e.g., as indicated by arrow F) and enter the first pump inlet 124 of the dispensing structure 123. The product 120 flowing (e.g., as indicated by arrow F) toward the dispensing structure 123 can contact the ball valve 188 and the valve seat 190. Due to the ball valve 188 and the valve seat 190 being in contact and forming a seal, the product 120 is substantially limited from flowing past the ball valve 188 and the valve seat 190.

Figure 4A:
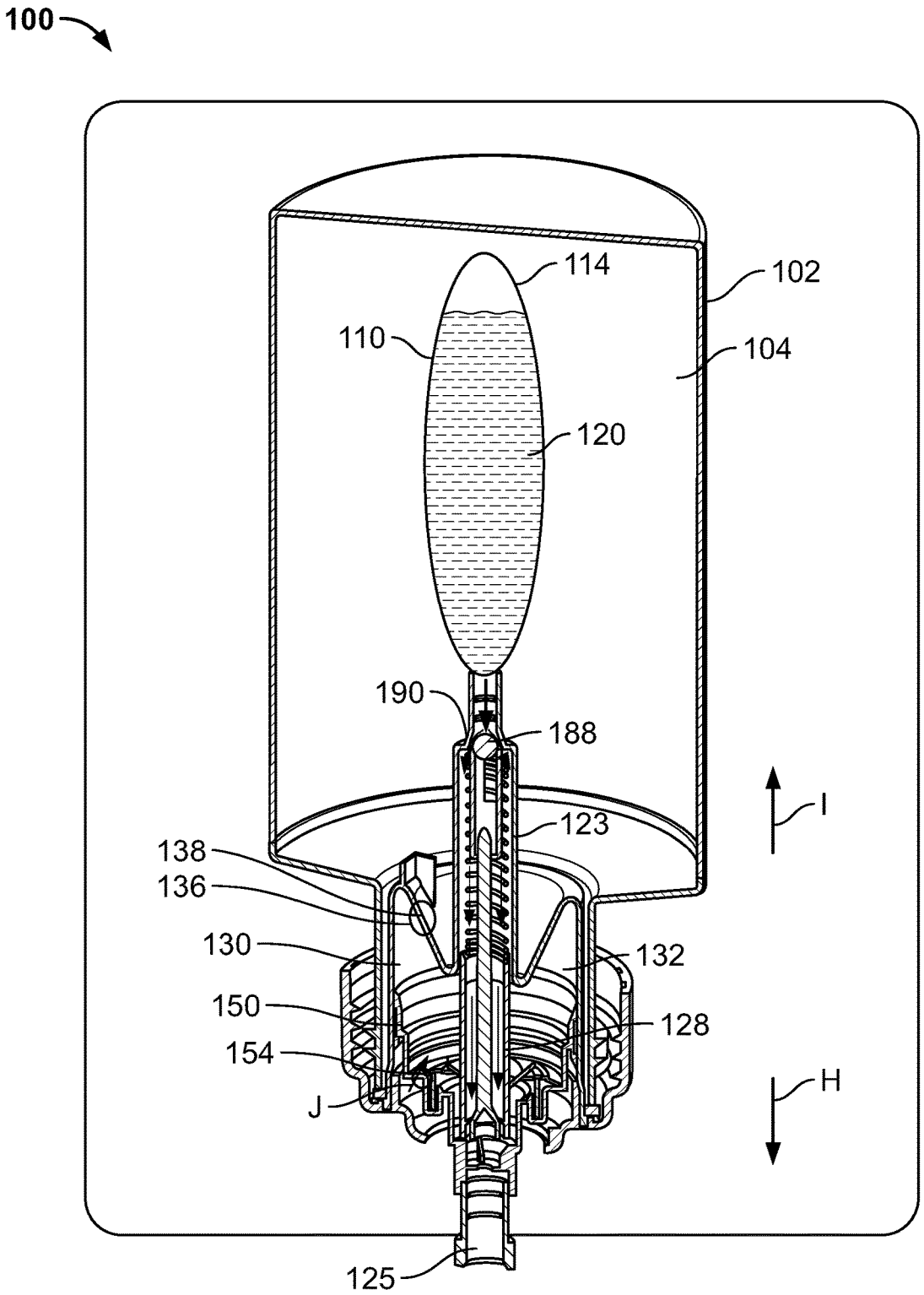
FIG. 4*a* is an illustration of an example dispensing system.

Turning now to FIG. 4*a*, the first valve 138 can move to the closed position when the second pressurization sidewall 150 of the pump 122 is moved with respect to the first pressurization sidewall 130 from a second position to a first position. For example, the second pressurization sidewall 150 can move downwardly with respect to the first pressurization sidewall 130 (e.g., as indicated by arrow H) and/or the first pressurization sidewall 130 can move upwardly with respect to the second pressurization sidewall 150 (e.g., as indicated by arrow I).

In response to this movement (e.g., as indicated by arrow H and/or arrow I), the second valve 154 can move from the closed position (illustrated in FIGS. 1 to 3) to an opened position (illustrated in FIG. 4*a*). With the second valve 154 in the opened position, the pressurization chamber 132 can be pressurized with pressurization material (e.g., air) flowing through the second pump inlet 152 and into the pressurization chamber 132 (e.g., as indicated by arrow J). This pressurization allows for the pressurization material to subsequently flow through the second pump outlet 136 when the first valve 138 is opened.

Additionally, as the second pressurization sidewall 150 moves in a direction away from the first pressurization sidewall 130 (e.g., as indicated by arrow H and/or arrow I), a vacuum or reduced pressure is formed in the dispensing structure 123. For example, the movable shaft 128 can move in a downward direction as the second pressurization sidewall 150 moves downwardly. This downward movement of the movable shaft 128 can also cause the ball valve 188 to move downwardly and out of contact with the valve seat 190 (e.g., by decompressing the spring), such that a gap, space, opening, etc. may be formed between the ball valve 188 and the valve seat 190. The product 120 can therefore flow through and/or be drawn into this gap, space, opening, etc. between the ball valve 188 and the valve seat 190. This downward movement of the movable shaft 128 can form a vacuum or reduced pressure within the movable shaft 128, thus further drawing the product 120 through the movable shaft 128 towards the first pump outlet 125. Accordingly, the simultaneous actions of pressurizing the first chamber 104 and drawing the movable shaft 128 downwardly can cause the product 120 to be expelled from the first container 110 and into the dispensing structure 123.

Figure 4B:
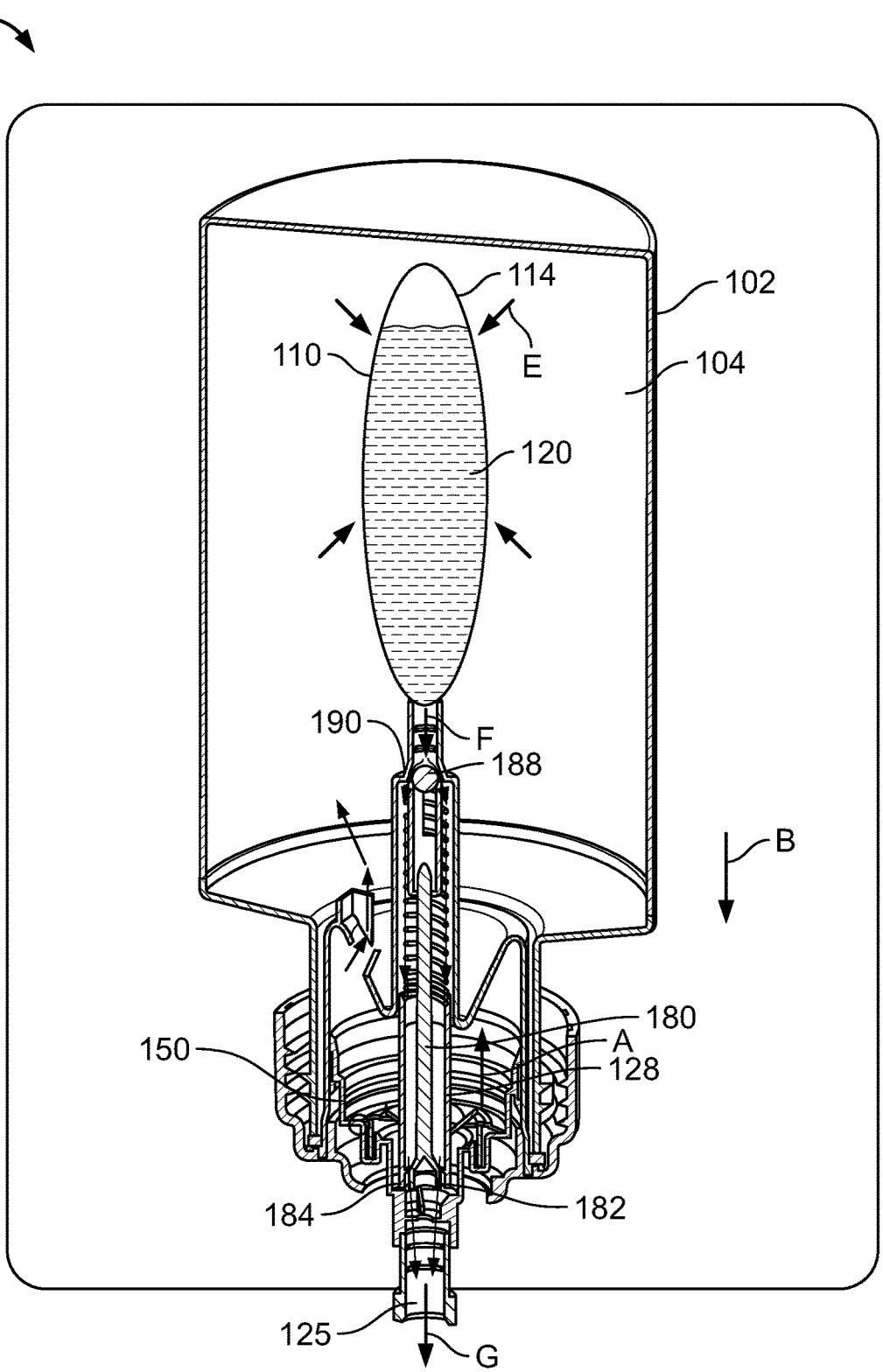
FIG. 4*b* is an illustration of an example dispensing system.

Turning now to FIG. 4*b*, the second pressurization sidewall 150 can again be moved from the first position to the second position (e.g., in response to movement as indicated by arrow A and/or arrow B). In this example, the movable shaft 128 can be moved upwardly. As the movable shaft 128 moves upwardly, the sealing portion 184 of the movable shaft 128 separates from and moves out of contact with the engagement portion 182. As such, a gap, space, opening, etc. is formed between the sealing portion 184 of the movable shaft 128 and the engagement portion 182 of the inner shaft 180. The product 120 that is within the dispensing structure 123 can therefore be expelled through the first pump outlet 125 (e.g., as indicated by arrow G). Additionally, as the movable shaft 128 moves upwardly, the ball valve 188 moves into contact with and/or seals with the valve seat 190 (e.g., due to the spring being compressed and/or forced upwardly). Due to the ball valve 188 sealing with the valve seat 190, the product 120 within the dispensing structure 123 is substantially limited from moving upwardly and back into the first container 110.

Figure 5:
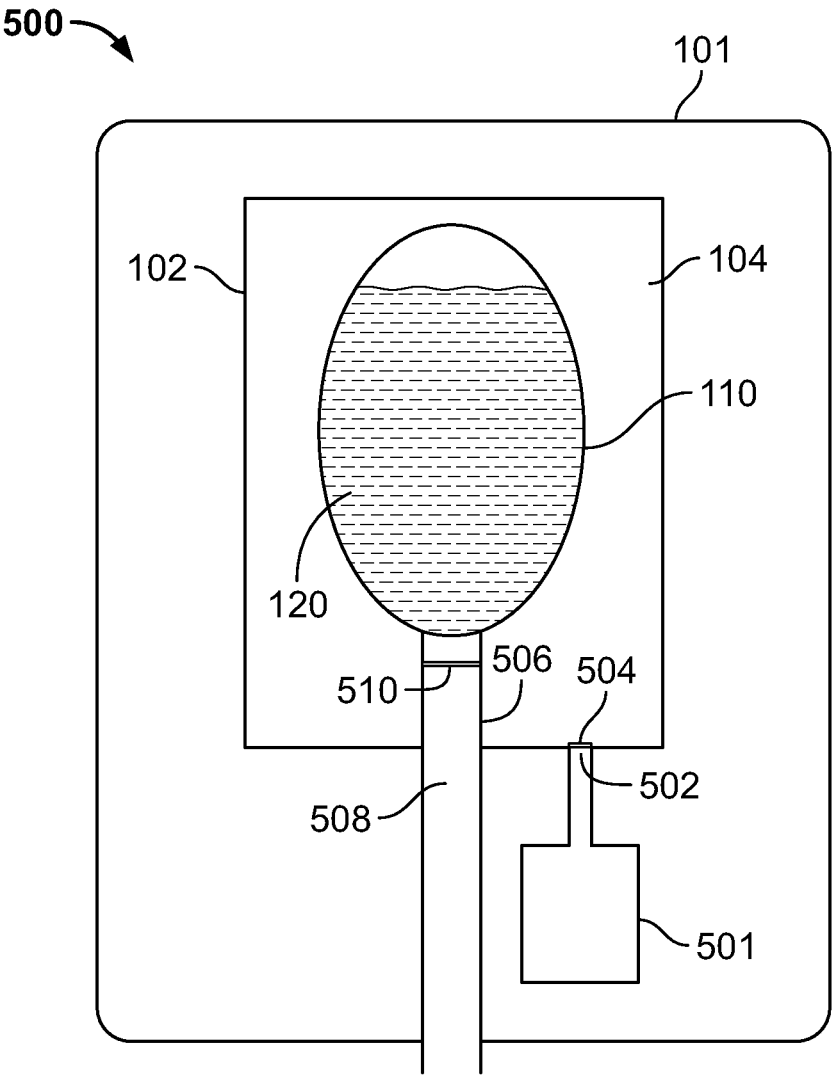
FIG. 5 is an illustration of an example dispensing system.

Turning now to FIG. 5, a second example dispensing system 500 is illustrated. The second dispensing system 500 is similar in some respects to the dispensing system 100 illustrated and described with respect to FIGS. 1 to 4. For example, the second dispensing system 500 comprises the second container 102 defining the first chamber 104, the first container 110 containing the product 120, etc.

In this example, the second dispensing system 500 comprises a pump 501. The pump 501 is illustrated schematically as the pump 501 comprises any number of structures, constructions, configurations, locations, etc. For example, while the pump 501 is illustrated adjacent a bottom wall of the second container 102, in other examples, the second container 102 could be located adjacent a side wall, top wall, or other wall of the second container 102. In further examples, the pump 501 can be positioned a distance away (e.g., remote from) and separated from the second container 102. As such, the location of the pump 501 in FIG. 5 is merely intended to illustrate a possible location, as other locations are envisioned.

The pump 501 in this example comprises a pressure vessel. For example, the pump 501 may comprise an air tank, air canister, compressed air storage device, or the like. Indeed, the pump 501 comprises any number of structures that can store gas and/or air at a pressure that is different (e.g., greater) than ambient pressure. The pump 501 comprises any number of sizes, and may be larger or smaller than as illustrated.

The pump 501 is in fluid communication with an opening 502 that is defined within the second container 102. As such, the pump 501 is in fluid communication with the first chamber 104. The pump 501 can be in fluid communication with the opening 502 in any number of ways. In some examples, the pump 501 can be attached directly to the second container 102 such that the pump 501 may partially or completely extend through the opening 502. In other examples, such as in the example illustrated, the pump 501 can be provided with hoses, tubes, conduits, or the like that attach the pump 501 to the opening 502.

Figure 6:
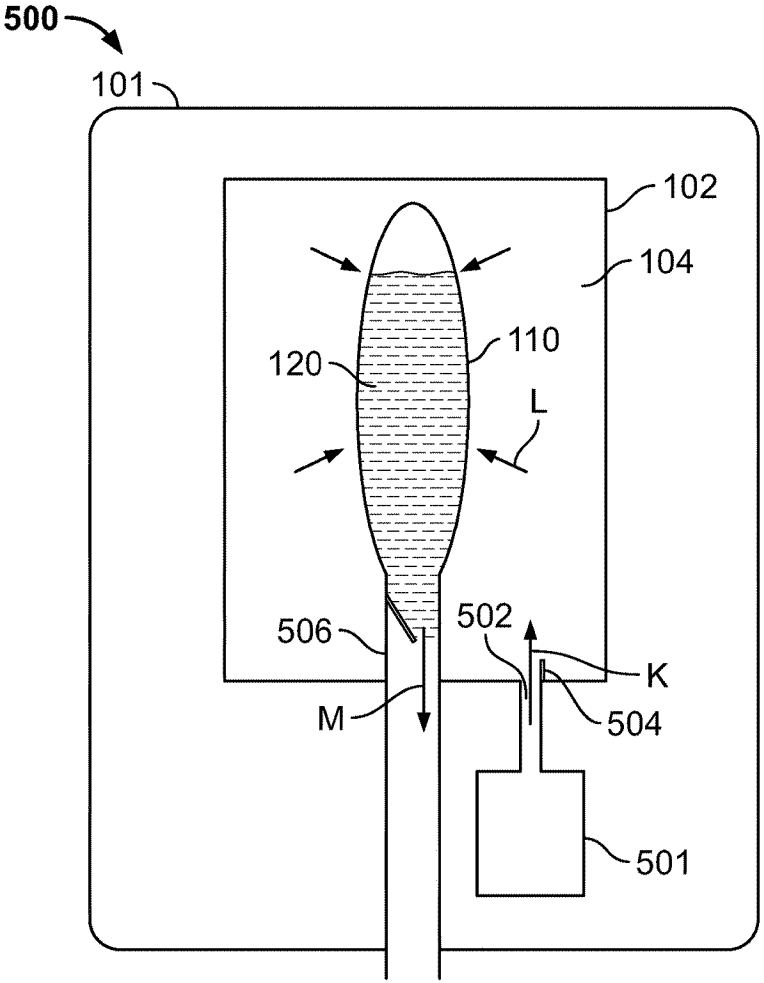
FIG. 6 is an illustration of an example dispensing system.

The pump 501 comprises a first valve 504. In this example, the first valve 504 is positioned adjacent the opening 502. The first valve 504 is movable between a closed position (as illustrated in FIG. 5) and an opened position (as illustrated in FIG. 6). When the first valve 504 is in the closed position, pressurization material is substantially limited from flowing through the opening 502. When the first valve 504 is in the opened position, pressurization material can flow through the opening 502. Pressurization material can flow from the pump 501, through the opening 502 (when the first valve 504 is in the opened position) and into the first chamber 104.

The dispensing system 500 comprises a dispensing structure 506. The dispensing structure 506 is disposed within a first container opening 508 defined by the second container 102. In an example, the dispensing structure 506 comprises a tube, nozzle, hose, conduit, or the like through which the product 120 can flow. The dispensing structure 506 can be attached at an end (e.g., at a top end) to the first container 110 such that the dispensing structure 506 is in fluid communication with the first container 110. An opposing end (e.g., a lower end) of the dispensing structure 506 can extend outwardly through the first container opening 508.

The dispensing structure 506 comprises a second valve 510. In this example, the second valve 510 is positioned in proximity to the first container opening 508, such as by being positioned within the dispensing structure 506. The second valve 510 is movable between a closed position (as illustrated in FIG. 5) and an opened position (as illustrated in FIG. 6). When the second valve 510 is in the closed position, the product 120 is substantially limited from flowing through the dispensing structure 506. When the second valve 510 is in the opened position, the product 120 can flow from the first container 110 and through the dispensing structure 506.

Turning to FIG. 6, an example operation of the second dispensing system 500 is illustrated. The pump 501 can pressurize (e.g., as indicated by arrow K) the first chamber 104 to a second chamber pressure that is greater than the first chamber pressure. As such, the first container 110 can deform in response to this second chamber pressure and the product 120 may be dispensed from the first container 110. In this example, the pump 501 can pressurize (e.g., as indicated by arrow K) the first chamber 104 by delivering pressurization material to the second container 102. For example, pressurization material (e.g., air or gas) can flow from the pump 501 and through the opening 502. This pressurization material flow can cause the first valve 504 to move from the closed position to the opened position, thus allowing for the pump 501 to pressurize (e.g., as indicated by arrow K) the first chamber 104.

As the first chamber 104 is pressurized (e.g., as indicated by arrow K), the first container 110 deforms in response to the second chamber pressure and the product 120 is dispensed from the first container 110. In this example, the first valve 504 can remain in the opened position as the pump 501 pressurizes (e.g., as indicated by arrow K) the second container 102.

The first container 110 can deform in response to the second chamber pressure. For example, due to the first container 110 being deformable (e.g., elastomeric material, nesting and/or movable portions of first container 110, etc.), a pressure (e.g., as indicated by arrow L) can act on walls of the first container 110 thus causing the first container 110 to deform.

It will be appreciated that the pressure (e.g., as indicated by arrow L) may be substantially uniform on the outer surface of the first container 110. In response to the deformation of the first container 110, the product 120 can be dispensed from the first container 110. In such an example, the product 120 can exit the first container 110 and flow (e.g., as indicated by arrow M) through the dispensing structure 506. The product 120 flowing (e.g., as indicated by arrow M) can cause the second valve 510 to move from the closed position to the opened position. As such, the product 120 can flow through the dispensing structure 506 and exit a bottom end the dispensing structure 506.

Figure 7:
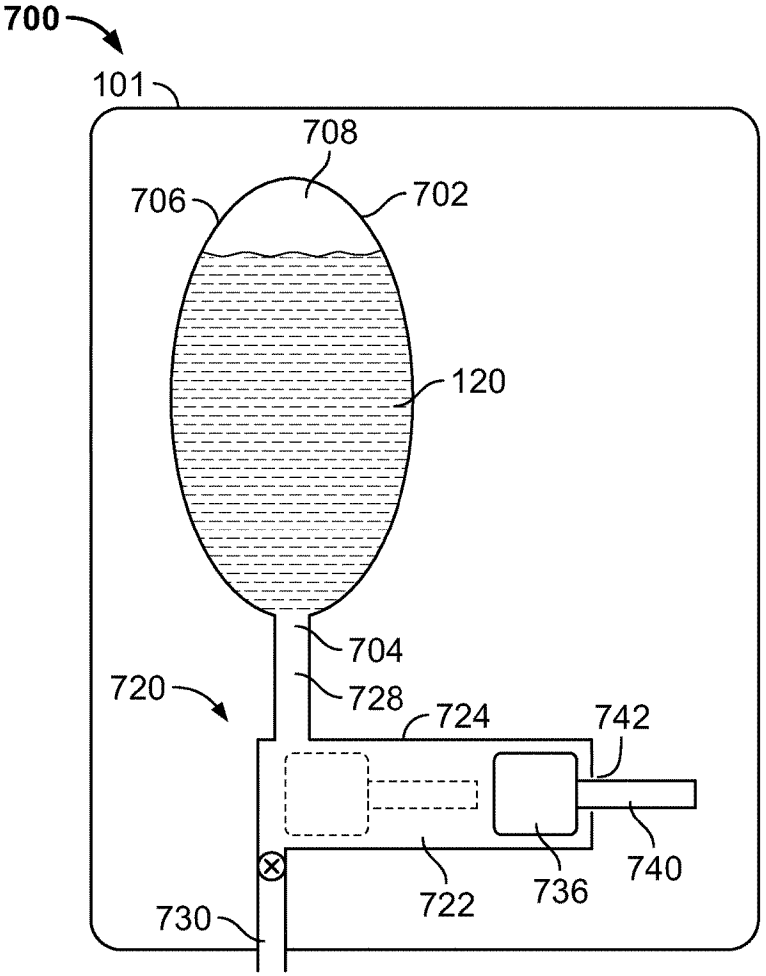
FIG. 7 is an illustration of an example dispensing system.

Turning to FIG. 7, a third example dispensing system 700 is illustrated. The third dispensing system 700 is similar in some respects to the dispensing system 100 illustrated and described with respect to FIGS. 1 to 4 and the dispensing system 500 illustrated and described with respect to FIGS. 5 and 6. For example, the third dispensing system 700 comprises the dispensing system housing 101.

The third dispensing system 700 comprises a first container 702. The first container 702 is disposed within the dispensing system housing 101. The first container 702 comprises an inner container, enclosure, etc. within the dispensing system housing 101. In an example, the first container 702 can be deformable. By being deformable, it is understood that the first container 702 may comprise an elastomeric material, similar to a balloon, a bladder, or the like. The first container 702 can contain and dispense the product 120.

Figure 9:
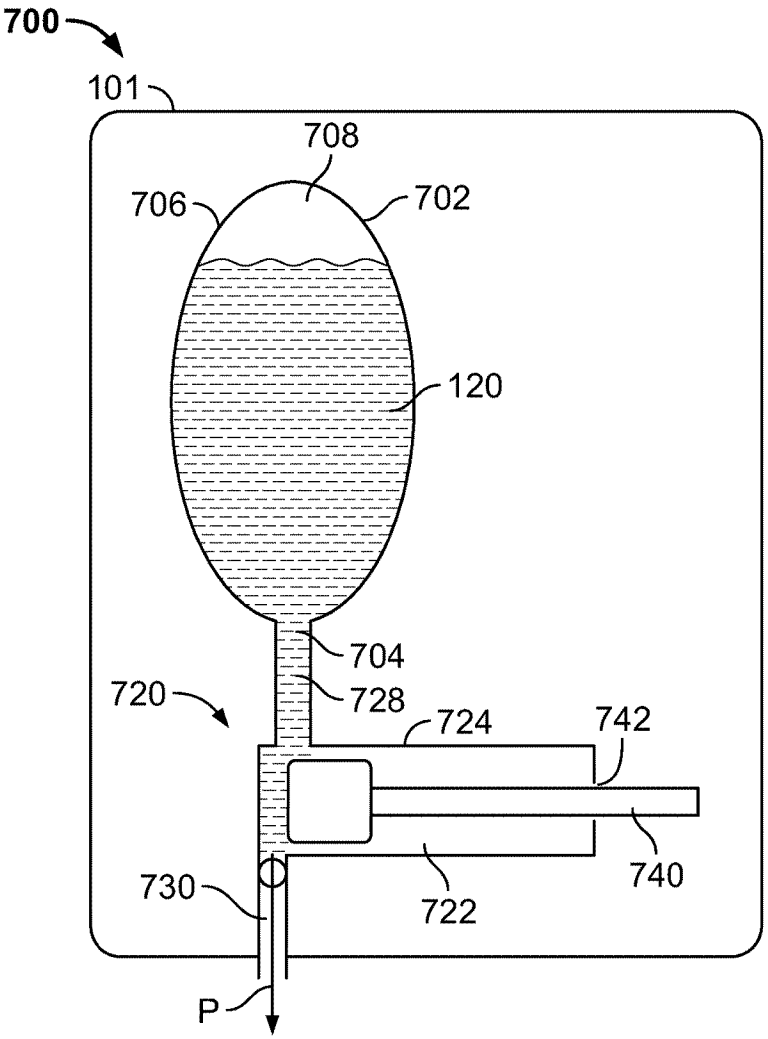
FIG. 9 is an illustration of an example dispensing system.
Figure 8:
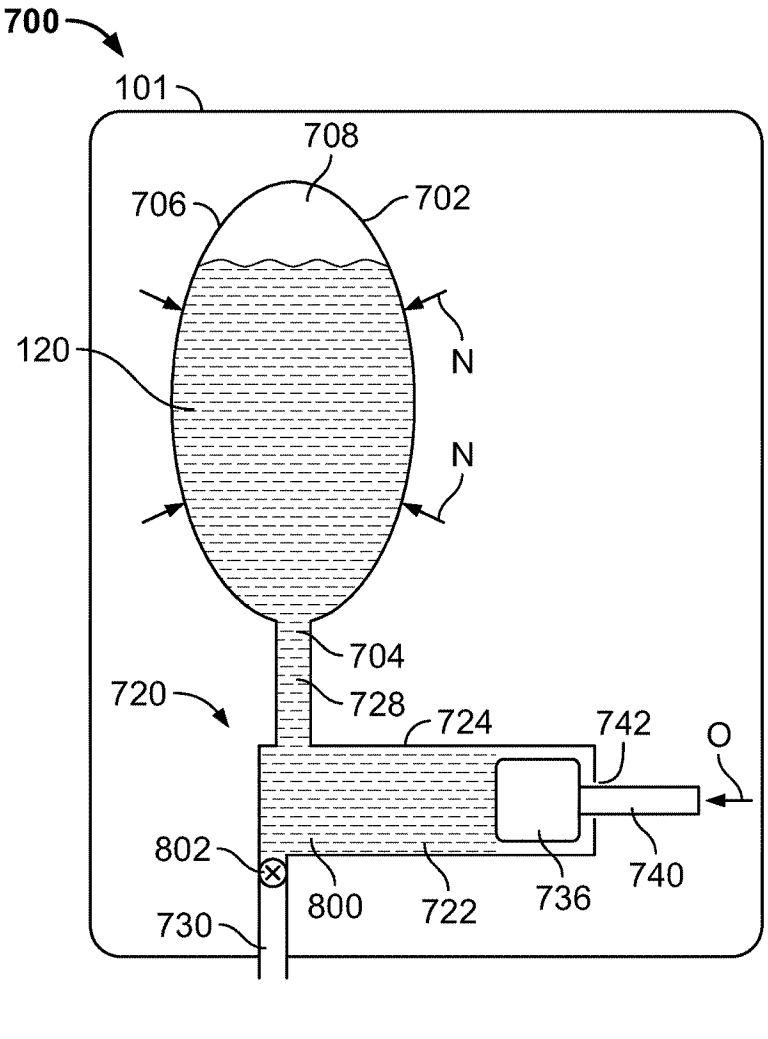
FIG. 8 is an illustration of an example dispensing system.

The first container 702 is expandable between an expanded state (e.g., as illustrated in FIGS. 7 and 8) and an unexpanded state (e.g., as illustrated in FIG. 9). In an example, the first container 702 has a tendency, propensity, inclination, etc. to remain in the unexpanded state. When the first container 702 is stretched and/or expanded to the expanded state, the first container 702 can exert pressure on the product 120 stored within the first container 702. This pressure can cause the product 120 to be expelled from the first container 702 through an outlet 704. The first container 702 comprises rubber, latex, polychloroprene, nylon fabrics, or other similar materials that have at least some degree of flexibility, expandable, compressible, elasticity, etc.

The first container 702 has an elastically deformable wall 706 that defines a changeable volume 708 for containing the product 120. The elastically deformable wall 706 is expandable between the unexpanded state and the expanded state. As the elastically deformable wall 706 moves from the expanded state to the unexpanded state, the changeable volume 708 decreases, such that the product 120 can be dispensed.

The third dispensing system 700 comprises a valve 720. The valve 720 is in fluid communication with the first container 702. The valve 720 is selectively engage-able and defines a fixed volumetric region 722 from which a predetermined amount 800 (e.g., illustrated in FIG. 8) of the product 120 can be expelled. The valve 720 comprises a cylinder 724 that defines the fixed volumetric region 722 within the cylinder 724. The cylinder 724 can have a circular cross-sectional shape, a quadrilateral cross-sectional shape (e.g., square, rectangular, etc.), an oval cross-sectional shape, or the like.

The cylinder 724 defines a valve inlet 728 and a valve outlet 730. The valve inlet 728 is in fluid communication with the first container 702 through the outlet 704. In such an example, the outlet 704 of the first container 702 is in fluid communication with the valve inlet 728 of the valve 720. As such, the product 120 can be selectively expelled from the first container 702, through the outlet 704, through the valve inlet 728 and into the fixed volumetric region 722 of the valve 720. The valve inlet 728 and the outlet 704 can be in fluid communication in any number of ways, such as by being directly attached, and/or by being attached with a tube, hose, conduit, etc. In the illustrated example, the valve inlet 728 is positioned at an upper surface of the cylinder 724 while the valve outlet 730 is positioned at a lower surface of the cylinder 724. Such positions are not intended to be limiting, however, and in other examples, the valve inlet 728 and/or the valve outlet 730 could be positioned along lateral surfaces (e.g., vertically extending) of the cylinder 724, along end surfaces, etc.

The valve 720 is illustrated with the cylinder 724 extending along a horizontal axis, such that the valve 720 has a substantially horizontal orientation. Such an orientation is not intended to be limiting, however, and in other examples, the valve 720 could have a substantially vertical orientation. In such an example, the valve inlet 728 could again be positioned at an upper surface of the cylinder 724 while the valve outlet 730 is positioned at the lower surface of the cylinder 724. In such an example, a displacement member (e.g., displacement member 736) could move up and down (e.g., vertically on the page).

The valve 720 further comprises a displacement member 736. The displacement member 736 is positioned within the cylinder 724. The displacement member 736 comprises a pump, piston, or the like. The displacement member 736 is movable within the cylinder 724, such that the displacement member 736 can move and expel the product 120 from the fixed volumetric region 722 through the valve outlet 730. In an example, the displacement member 736 has a cross-sectional size that is similar to a cross-sectional size of the fixed volumetric region 722 of the cylinder 724. As such, outer radial edges of the displacement member 736 are adjacent to and/or in contact with an inner radial surface of the cylinder 724. In some examples, the displacement member 736 can form a seal with the cylinder 724. The displacement member 736 can be moved between a first position (e.g., illustrated in FIG. 7 with solid lines) and a second position (e.g., illustrated in FIG. 7 with dashed lanes).

An actuator 740 is operatively coupled to the valve 720 to selectively engage the valve 720. In this example, the actuator 740 extends through an actuator opening 742 in the cylinder 724, with the actuator 740 attached to the displacement member 736. The actuator 740 selectively engages the valve by moving the displacement member 736 between a first position and a second position. The actuator 740 can move the displacement member 736 in any number of ways. In some examples, the actuator 740 can be selectively moved in response to a mechanical force, an electromagnetic force, an electrical force, or the like.

Turning to FIG. 8, the displacement member 736 may initially be moved to and/or placed in the first position. In the first position, the displacement member 736 is located at an opposite end of the cylinder 724 from the valve outlet 730, with the valve inlet 728 located in closer proximity to the valve outlet 730 than the displacement member 736. With the displacement member 736 in the first position, the displacement member 736 does not block the valve inlet 728. As such, the product 120 can be expelled from the first container 702, through the outlet 704, and through the valve inlet 728 into the fixed volumetric region 722.

The product 120 can be expelled from the first container 702 in response to pressure (e.g., as indicated by arrows N) exerted on the product 120 by the elastically deformable wall 706. In this example, the elastically deformable wall 706 stores potential energy in the expanded state (e.g., when the first container 702 is filled with the product 120 and expanded). The elastically deformable wall 706 can therefore exert pressure (e.g., as indicated by arrows N) on the product 120, thus causing some of the product 120 to be expelled from the first container 702 and through the outlet 704.

A predetermined amount 800 of the product 120 can flow into the fixed volumetric region 722 of the valve 720 when the displacement member 736 is in the first position. In one possible example, the predetermined amount 800 can correspond to a single dosage of the product 120 for distribution to a user. In an example, the predetermined amount 800 can correspond to a volume of the cylinder 724, which is a length (L) of the cylinder 724 (e.g., from the valve outlet 730 to the displacement member 736 in the first position) multiplied by a cross-sectional area of the cylinder (e.g., $\pi*r^2$), which may be pi times a radius of the cylinder 724 squared. As such, in this example, the predetermined amount 800 is equal to $L*\pi*r^2$.

An outlet valve 802 may be provided in the valve outlet 730. The outlet valve 802 comprises a check valve, one way valve, or the like. The outlet valve 802 can control and limit the unintended expulsion of the predetermined amount 800 of the product 120 from the fixed volumetric region 722. For example, the outlet valve 802 can initially be in a closed position when the displacement member 736 is in the first position. The outlet valve 802 can remain in the closed position at least until the displacement member 736 is moved from the first position to the second position.

Turning to FIG. 9, the displacement member 736 can be moved (e.g., as indicated by arrow O in FIG. 8) from the first position (e.g., as indicated in FIG. 8) to the second position. In an example, the displacement member 736 can be moved in response to movement of the actuator 740. As the displacement member 736 moves (e.g., as indicated by arrow O in FIG. 8) to the second position, the displacement member 736 can force the predetermined amount 800 of the product 120 towards and through the valve outlet 730 (e.g., leftward in FIG. 9). This force applied by the displacement member 736 to the predetermined amount 800 of the product 120 is at least enough to cause the outlet valve 802 to move from the closed position (e.g., as indicated in FIG. 8) to an opened position. With the outlet valve 802 in the opened position, movement of the displacement member 736 to the second position allows the predetermined amount 800 of the product 120 to flow out (e.g., as indicated by arrow P) through the valve outlet 730.

The dispensing system 100, 500, 700 illustrated and described herein provides a number of benefits. For example, due to the first container 110 being deformable, the dispensing system 100, 500, 700 utilizes elastic energy that is inherent in the deformable first container 110 to help propel and emit relatively highly viscous product 120 from the first container. This is beneficial, at least in part, because this product 120 may not self-settle by gravity into a dispensing structure, pump, or the like. Additionally, in some examples, the dispensing system 100, 500 allows for pressurization of the second container 102, thus allowing for easier dispensing of the product 120.

Although the subject matter has been described in language specific to structural features or methodological acts, it is to be understood that the subject matter defined in the appended claims is not necessarily limited to the specific features or acts described above. Rather, the specific features and acts described above are disclosed as example forms of implementing at least some of the claims.

Various operations of embodiments are provided herein. The order in which some or all of the operations described should not be construed to imply that these operations are necessarily order dependent. Alternative ordering will be appreciated having the benefit of this description. Further, it will be understood that not all operations are necessarily present in each embodiment provided herein. Also, it will be understood that not all operations are necessary in some embodiments.

Many modifications may be made to the instant disclosure without departing from the scope or spirit of the claimed subject matter. Unless specified otherwise, "first," "second," or the like are not intended to imply a temporal aspect, a spatial aspect, an ordering, etc. Rather, such terms are merely used as identifiers, names, etc. for features, elements, items, etc. For example, a first component and a second component correspond to component A and component B or two different or two identical components or the same component.

Moreover, "exemplary" is used herein to mean serving as an example, instance, illustration, etc., and not necessarily as advantageous. As used in this application, "or" is intended to mean an inclusive "or" rather than an exclusive "or". In addition, "a" and "an" as used in this application are to be construed to mean "one or more" unless specified otherwise or clear from context to be directed to a singular form. Also, at least one of A and B or the like means A or B or both A and B. Furthermore, to the extent that "includes", "having", "has", "with", or variants thereof are used in either the detailed description or the claims, such terms are intended to be inclusive in a manner similar to "comprising".

Also, although the disclosure has been illustrated and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. A dispensing system for dispensing an associated substantially viscous product, the dispensing system comprising:

a dispensing system housing;

a first container disposed within the dispensing system housing and having an elastically deformable wall defining a changeable volume for containing the associated product, the elastically deformable wall expandable between an unexpanded state and an expanded state, the first container comprising an outlet through which the associated product is expelled, wherein potential energy stored in the deformable wall in the expanded state is operable to expel the associated product from the first container through the outlet;

a selectively engage-able valve operatively fluidly connected to the outlet for controlling the expulsion of a predetermined amount of the associated product from the outlet; and an actuator operatively coupled to the valve to selectively engage the valve;

wherein a first chamber is defined between the first container and a second container that envelopes the first container and is disposed within the dispensing system housing, and wherein the second container defines an opening at which a pump is attached to the second container for introduction of a pressurization material into the first chamber to increase a pressure applied to the first container.

2. The dispensing system of claim 1, wherein the selectively engage-able valve defines a fixed volumetric region from which the predetermined amount of associated product is expelled and wherein the selectively engage-able valve comprises a valve inlet and a valve outlet.

3. The dispensing system of claim 2, wherein the valve comprises a displacement member moveable between a first and a second position.

4. The dispensing system of claim 3, wherein movement of the displacement member to the first position allows the associated product to flow into the fixed volumetric region.

5. The dispensing system of claim 4, wherein movement of the displacement member to the second position allows the associated product to flow out through the valve outlet.

6. A dispensing system for dispensing an associated substantially viscous product, the dispensing system comprising:

a dispensing system housing;

a first container supported by the dispensing system housing, the first container having a deformable body defining a changeable volume for containing the associated product, the first container comprising an outlet through which the associated product is expelled from, wherein the deformable body is expandable between an unexpanded state and an expanded state;

a second container supported by the dispensing system housing, the second container being pressurize-able, wherein the first container is disposed at least partially within the second container; and a pump having a pump inlet and a pump outlet, wherein the pump inlet is operatively connected to the outlet, the pump configured to receive the associated product that is expelled from the outlet of the first container through the pump inlet, the associated product exiting the pump through the pump outlet;

wherein the pump comprises a second pump outlet, the second pump outlet being operatively connected to the second container for use in pressurizing the second container when the pump is actuated.

7. The dispensing system as defined in claim 6, wherein the first container has elastically deformable walls.

8. A dispensing system for dispensing an associated substantially viscous product, the dispensing system comprising:

a dispensing system housing;

a first container disposed within the dispensing system housing and having an elastically deformable wall defining a changeable volume for containing the associated product, the elastically deformable wall expandable between an unexpanded state and an expanded state, the first container comprising an outlet through which the associated product is expelled, wherein potential energy stored in the deformable wall in the expanded state is operable to expel the associated product from the first container through the outlet;

a selectively engage-able valve operatively fluidly connected to the outlet for controlling the expulsion of a predetermined amount of the associated product from the outlet; and an actuator operatively coupled to the valve to selectively engage the valve;

wherein the selectively engage-able valve defines a fixed volumetric region from which the predetermined amount of associated product is expelled and wherein the selectively engage-able valve comprises a valve inlet and a valve outlet;

wherein the valve comprises a displacement member moveable between a first and a second position.

* * * * *